US010389024B2

(12) United States Patent
Tseng et al.

(10) Patent No.: US 10,389,024 B2
(45) Date of Patent: Aug. 20, 2019

(54) ANTENNA STRUCTURE

(71) Applicant: WISTRON NEWEB CORPORATION, Hsinchu (TW)

(72) Inventors: Shih-Hsien Tseng, Hsinchu (TW); Chia-Hao Chang, Hsinchu (TW)

(73) Assignee: WISTRON NEWEB CORPORATION, Hsinchu (TW)

( * ) Notice: Subject to any disclaimer, the term of this patent is extended or adjusted under 35 U.S.C. 154(b) by 23 days.

(21) Appl. No.: 15/863,602

(22) Filed: Jan. 5, 2018

(65) Prior Publication Data

US 2019/0020111 A1 Jan. 17, 2019

(30) Foreign Application Priority Data

Jul. 17, 2017 (TW) ..... 106123810 A

(51) Int. Cl.

| | |
|---|---|
| ***H01Q 1/48*** | (2006.01) |
| ***H01Q 5/335*** | (2015.01) |
| ***H01Q 9/04*** | (2006.01) |
| ***H01Q 1/24*** | (2006.01) |
| ***H01Q 9/16*** | (2006.01) |
| ***H01Q 9/42*** | (2006.01) |
| ***H01Q 5/328*** | (2015.01) |
| ***H01Q 5/371*** | (2015.01) |
| ***H01Q 5/378*** | (2015.01) |

(52) U.S. Cl.

CPC ..... *H01Q 5/335* (2015.01); *H01Q 1/242* (2013.01); *H01Q 1/243* (2013.01); *H01Q 1/48* (2013.01); *H01Q 5/328* (2015.01); *H01Q 5/371* (2015.01); *H01Q 5/378* (2015.01); *H01Q 9/0421* (2013.01); *H01Q 9/16* (2013.01); *H01Q 9/42* (2013.01)

(58) Field of Classification Search

CPC ..... H01Q 5/335; H01Q 5/328; H01Q 5/371; H01Q 5/378; H01Q 1/242; H01Q 1/243; H01Q 1/48; H01Q 9/0421; H01Q 9/16; H01Q 9/42

See application file for complete search history.

(56) References Cited

U.S. PATENT DOCUMENTS 8,552,912 B2 10/2013 Wang et al.
2015/0200456 A1 * 7/2015 You ..... H01Q 9/42 343/722

* cited by examiner

*Primary Examiner* — Graham P Smith
(74) *Attorney, Agent, or Firm* — Li & Cai Intellectual Property (USA) Office

(57) ABSTRACT

An antenna structure includes a substrate, a radiation element, a conducting element, a grounding element, a first inductor, a second inductor, and a feeding element. The radiation element is disposed on the substrate. The radiation element includes a first radiation portion, a second radiation portion, a third radiation portion, and a feeding portion connected between the first radiation portion, the second radiation portion, and the third radiation portion. The conducting element is disposed on the substrate. The conducting element connects with the feeding portion. The grounding element and the feeding portion are separated from each other. The first inductor is disposed on the substrate, and coupled between the conducting element and the grounding element. The second inductor is disposed on the substrate, and coupled between the conducting element and the grounding element.

16 Claims, 10 Drawing Sheets

ANTENNA STRUCTURE

FIELD OF THE INVENTION

The present disclosure relates to an antenna structure, especially to an antenna structure with a plurality of operation bands.

BACKGROUND OF THE INVENTION

The wireless communication technology for increasing portable electronic devices (such as smart phone, tablet, and notebook) has obtained more attention in recent years, and the quality of the wireless communication usually depends on the efficiency of antenna in the portable electronic device. Therefore, it is important to improve radiation efficiency of the antenna and to be able to easily adjust overall frequency.

In addition, with the coming of the next generation of communication technology, 5G licensed assisted access (LAA), the design of the existing antenna structure, such as planar inverted-F antenna (PIFA), may not meet the band requirements of the 5G communication system. As disclosed in U.S. Pat. No. 8,552,912 "Antenna for thin communication apparatus", the ground segments 112, 114 are used to increase the bandwidth. However, the 5G communication system has a higher demand for band and bandwidth, and the antenna disclosed in said patent cannot cover both the bands of 4G and 5G.

SUMMARY OF THE INVENTION

The object of the present disclosure is to provide an antenna structure covering both the bands of 4G and 5G.

Accordingly, an embodiment of the present disclosure provides an antenna structure, the antenna structure includes a substrate; a radiation element disposed on the substrate, the radiation element including a first radiation portion, a second radiation portion, a third radiation portion and a feeding portion connected between the first radiation portion, the second radiation portion and the third radiation portion; a conducting element disposed on the substrate and connected between the feeding portion; a grounding element separated from the feeding portion; a first inductor disposed on the substrate and coupled between the conducting element and the grounding element; a second inductor disposed on the substrate and coupled between the conducting element and the grounding element; and a feeding element coupled between the feeding portion and the grounding element and used to feed a signal.

The present disclosure is advantageous in that the antenna structure provided has at least the characteristics of "the first inductor is coupled between the conducting element and the grounding element", "the second inductor is coupled between the conducting element and the grounding element" and "the feeding element is coupled between the feeding portion and the grounding element to be used to feed a signal" so as to make the antenna structure cover both the bands of 4G and 5G.

To further understand the techniques, means and effects of the present disclosure, the following detailed descriptions and appended drawings are hereby referred to, such that, and through which, the purposes, features and aspects of the present disclosure can be thoroughly and concretely appreciated. However, the appended drawings are provided solely for reference and illustration, without any intention to limit the present disclosure.

BRIEF DESCRIPTION OF THE DRAWINGS

The accompanying drawings are included to provide a further understanding of the present disclosure, and are incorporated in and constitute a part of this specification. The drawings illustrate exemplary embodiments of the present disclosure and, together with the description, serve to explain the principles of the present disclosure.

DETAILED DESCRIPTION OF THE PREFERRED EMBODIMENTS

Embodiments of a portable electronic device and a back cover assembly thereof according to the present disclosure are described herein. Other advantages and objectives of the present disclosure can be easily understood by one skilled in the art from the disclosure. The present disclosure can be applied in different embodiments. Various modifications and variations can be made to various details in the description for different applications without departing from the scope of the present disclosure. The drawings of the present disclosure are provided only for simple illustrations, but are not drawn to scale and do not reflect the actual relative dimensions. The following embodiments are provided to describe in detail the concept of the present disclosure, and are not intended to limit the scope thereof in any way.

Figure 1:
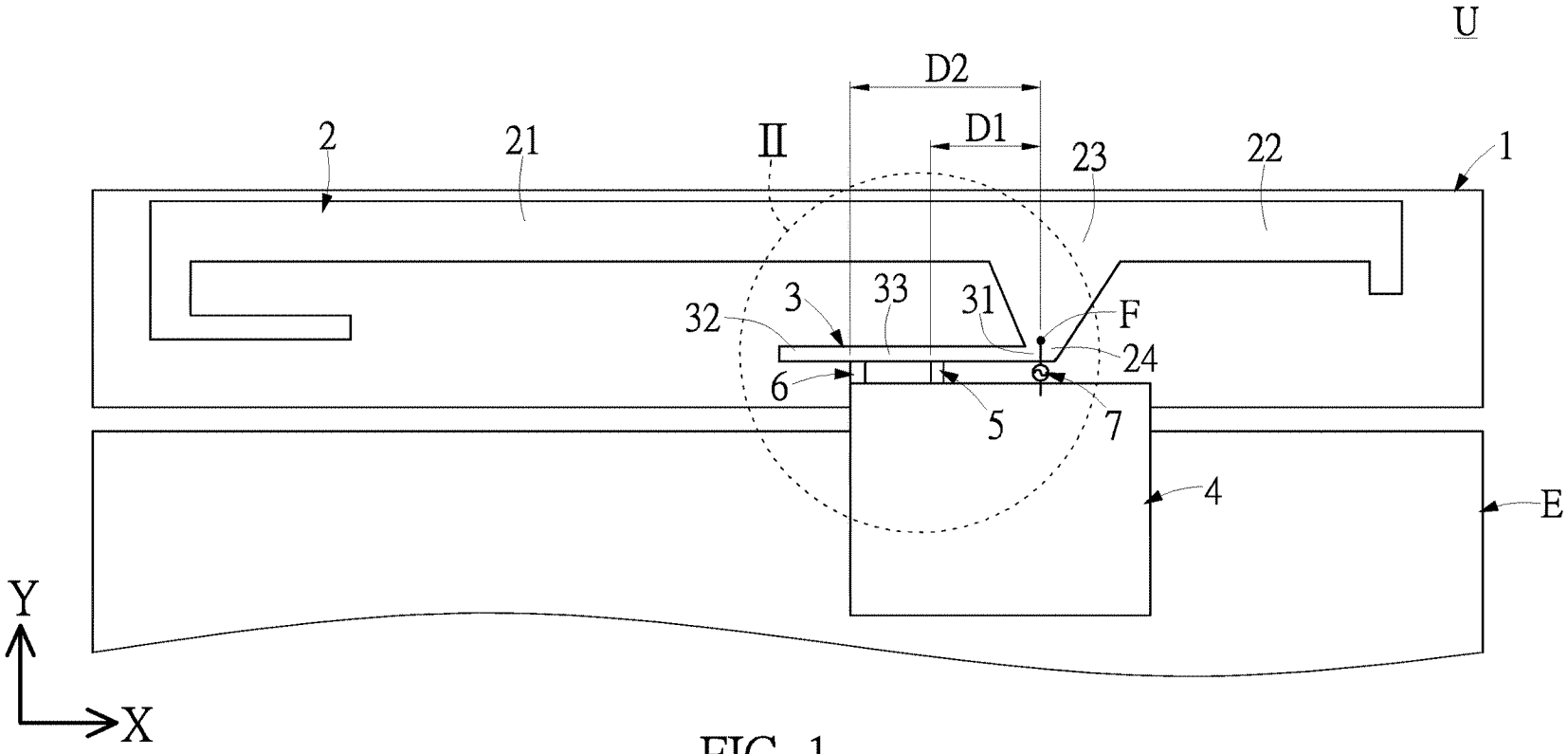
FIG. 1 shows a top view of an antenna structure according to a first embodiment of the present disclosure.

First, please refer to FIG. 1, showing a top view of an antenna structure U according to a first embodiment of the present disclosure. The present disclosure provides an antenna structure U including a substrate 1, a radiation element 2, a conducting element 3, a grounding element 4, a first inductor 5, a second inductor 6 and a feeding element 7. The radiation element 2 and the conducting element 3 may be disposed on the substrate 1, and the conducting element 3 may be connected to a feeding portion 24 of the radiation element 2. In addition, the feeding portion 24 of the radiation element 2 and the grounding element 4 are separated from each other. Furthermore, the first inductor 5 may be disposed on the substrate 1, and the first inductor 5 may be coupled between the conducting element 3 and the grounding element 4. Meanwhile, the second inductor 6 may be disposed on the substrate 1, and the second inductor 6 may be coupled between the conducting element 3 and the grounding element 4. The feeding element 7 may be coupled between the feeding portion 24 and the grounding element 4, and the feeding element 7 is used to feed a signal.

As mentioned above, it should be noted that, the substrate 1, the radiation element 2, the conducting element 3, the grounding element 4 and the feeding element 7 may be formed by any type of conductive material, and the aforementioned elements may also be formed by any forming method, so that details thereon will be omitted herein. For example, the radiation element 2 and the conducting element 3 may be a metal sheet, a metal wire or other conductive materials. In addition, the substrate 1 may be a printed circuit board (PCB). Furthermore, the feeding element 7 may be a coaxial cable. It should be noted that, the present disclosure is not limited by the aforementioned examples.

As mentioned above, please refer to FIG. 1, the radiation element 2 may be integrally formed with the conducting element 3, that is, the radiation element 2 and the conducting element 3 may be a metal sheet. In addition, the grounding element 4 may be electrically connected to a metal conductor E, while the metal conductor E may be separated from the substrate 1. Further, in the embodiment of the present disclosure, the radiation element 2 may include a first radiation portion 21, a second radiation portion 22, a third radiation portion 23 and a feeding portion 24 connected between the first radiation portion 21, the second radiation portion 22 and the third radiation portion 23. The first radiation portion 21 and the conducting element 3 may extend along a first direction (along negative X direction) relative to the feeding portion 24, while the second radiation portion 22 may extend along a second direction (along positive X direction) relative to the feeding portion 24, the first direction (negative X direction) being different from the second direction (positive X direction). For example, in the embodiment in FIG. 1, the first direction (negative X direction) is reverse to the second direction (positive X direction). In addition, the third radiation portion 23 may be disposed between the first radiation portion 21 and the second radiation portion 22, and the third radiation portion 23 overlaps with part of the first radiation portion 21 and part of the second radiation portion 22.

Figure 2:
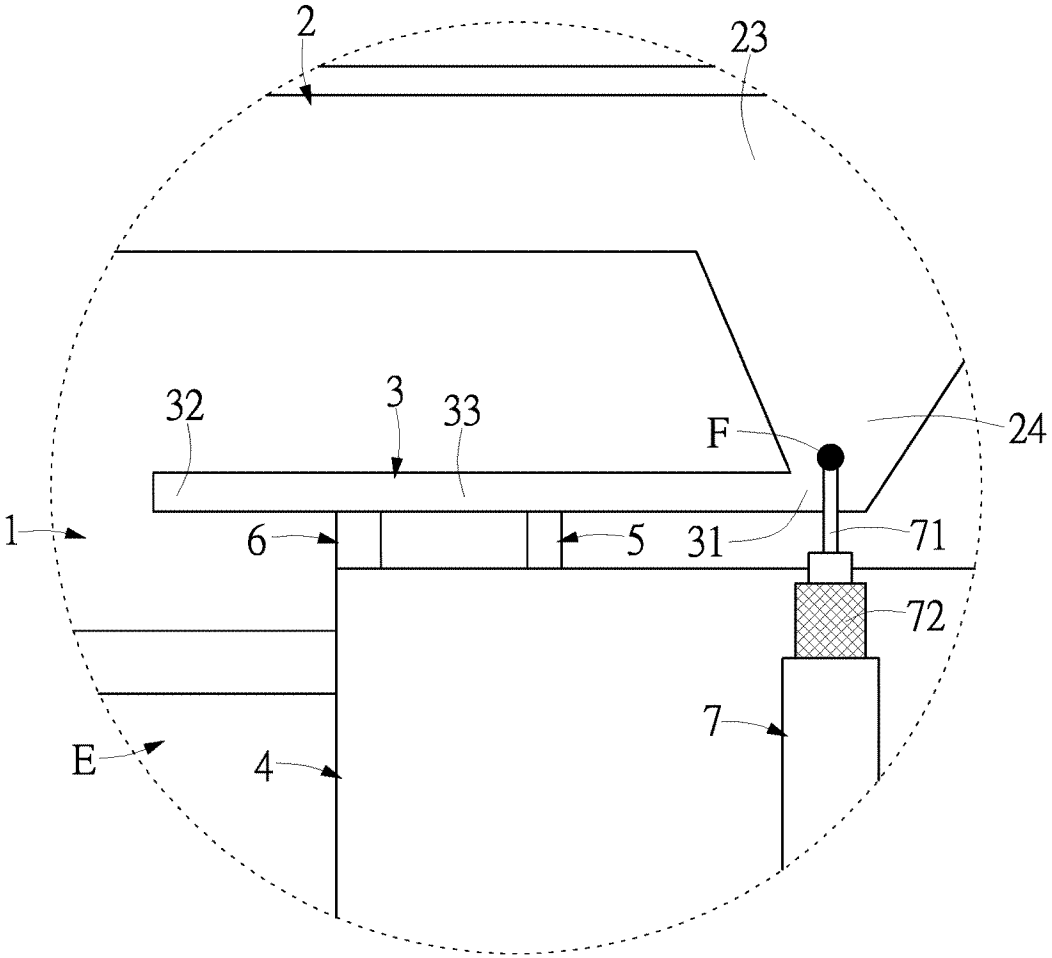
FIG. 2 is a diagram illustrating the connection between a radiation element, a feeding element and a grounding element of the antenna structure according to the first embodiment of the present disclosure.

In continuation of the above, please refer to FIG. 1 and FIG. 2, in which FIG. 2 shows an expanded view of section II in FIG. 1. For example, the feeding element 7 may be a coaxial cable, the feeding element 7 has a feeding end 71 and a grounding end 72, the feeding end 71 may be electrically connected to the feeding portion 24, the grounding end 72 may be electrically connected to the grounding element 4. However, the present disclosure is not limited by the aforementioned examples. It should be noted that, for being readily appreciated, substitute symbols are used in other diagrams for the structure of the coaxial cable as shown in FIG. 2.

As mentioned above, please refer to FIG. 1, in which the conducting element 3 has a first end 31, a second end 32 opposite to the first end 31 and a body portion 33 connected between the first end 31 and the second end 32. The first end 31 is connected to the feeding portion 24. In this way, as shown in FIG. 1, the second end 32 is a part opposite to the first end 31 and extending along a first direction (negative X direction). In addition, a feeding point is disposed between the feeding end 71 of the feeding element 7 and the conducting element 3, or a feeding point is disposed between the feeding end 71 of the feeding element 7 and the feeding portion 24 is defined as a feeding point F. In this way, the feeding element 7 may be coupled to the feeding portion 24 through the conducting element 3, or the feeding element 7 may directly connected to the feeding portion 24. In the first embodiment, the feeding end 71 of the feeding element 7 may be connected to the feeding portion 24 of the radiation element 2.

Further, please refer to FIG. 1, in the first embodiment, one end of the first inductor 5 may be coupled to the body portion 33 of the conducting element 3, and the other end of the first inductor 5 may be coupled to the grounding element 4. In addition, one end of the second inductor 6 may be coupled to the body portion 33 of the conducting element 3, the other end of the second inductor 6 may be coupled to the grounding element 4. Meanwhile, the first radiation portion 21 may be opposite to the feeding element 7 and disposed on a first side of the feeding element 7, the second radiation portion 22 may be disposed on a second side (opposite side) of the feeding element 7, and the first inductor 5 and the second inductor 6 may be disposed on the first side. In other words, the first inductor 5 and the second inductor 6 are both disposed on the same side relative to the feeding point F. However, the present disclosure is not limited to that disclosed in this embodiment. Further, as shown in FIG. 1, the first radiation portion 21 may be disposed on the left side of the feeding element 7, the second radiation portion 22 may be disposed on the right side of the feeding element 7, and the first inductor 5 and the second inductor 6 are both disposed on the left side of the feeding element 7. It should be noted that, in other embodiments of the present disclosure (please refer to the third embodiment), the first inductor 5 and the second inductor 6 may respectively be disposed on two opposite sides of the feeding point F.

Figure 3:
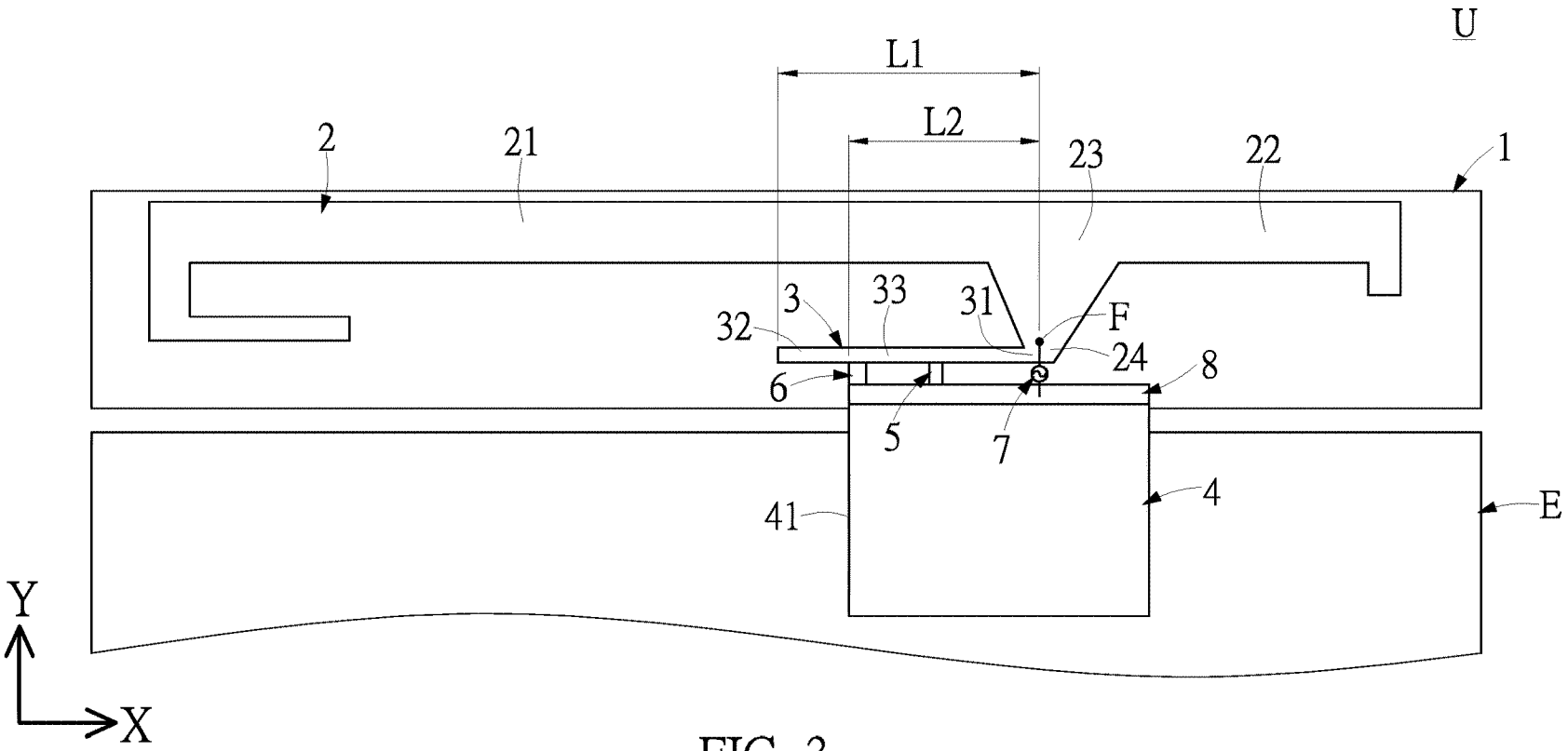
FIG. 3 shows another top view of the antenna structure according to the first embodiment of the present disclosure.

Next, please refer to FIG. 3, it can be known by comparing FIG. 3 and FIG. 1 that the embodiment shown in FIG. 3 mainly differs from that in FIG. 1 in that: the antenna structure U shown in FIG. 3 may preferably further include a bridge element 8, the bridge element 8 may be disposed on the substrate 1, and the bridge element 8 may be coupled between the grounding element 4 and the first inductor 5, and the second inductor 6 and the feeding element 7. In other words, one end of the first inductor 5 may be coupled to the body portion 33 of the conducting element 3, the other end of the first inductor 5 may be coupled to the bridge element 8 so that the first inductor 5 may be coupled to the grounding element 4 through the bridge element 8. In addition, one end of the second inductor 6 may be coupled to the body portion 33 of the conducting element 3, and the other end of the second inductor 6 may be coupled to the bridge element 8, so that the second inductor 6 may be coupled to the grounding element 4 through the bridge element 8. Furthermore, the feeding end 71 of the feeding element 7 may be coupled to the conducting element 3, and the grounding end 72 of the feeding element 7 may be coupled to the bridge element 8 so that the feeding element 7 may be coupled to the grounding element 4 through the bridge element 8. It should be noted that, since the structure shown in FIG. 3 is similar to that shown in FIG. 1, further description thereon will be omitted herein.

As mentioned above, it should be noted that, in the embodiment shown in FIG. 3, the bridge element 8 is disposed to make the grounding element 4 easily attach to the substrate 1. Though the bridge element 8 may be further disposed in the diagram shown in FIG. 3, in other embodiments, the bridge element 8 may not be disposed. In addition, it should be noted that, for example, the bridge element 8 may be formed with tin or other conductive materials, the grounding element 4 may be formed with copper or other conductive materials, but the present disclosure is not limited thereto.

Further, please refer to FIG. 1 and FIG. 3, a first preset distance Ll is between the feeding point F and the second end 32, a second preset distance L2 is between the feeding point F and an edge 41 of the grounding element 4. The edge 41 of the grounding element 4 extends along the first direction (negative X direction), the first preset distance L1 is greater than the second preset distance L2. In other words, the second end 32 of the conducting element 3 protrudes relative to the edge 41 of the grounding element 4. In addition, a first predetermined distance D1 is between the first inductor 5 and the feeding point F, a second predetermined distance D2 is between the second inductor 6 and the feeding point F, the first predetermined distance D1 may be smaller than the second predetermined distance D2. Furthermore, it should be noted that, in the embodiment of the present disclosure, an inductance of the first inductor 5 may be smaller than that of the second inductor 6.

Figure 4:
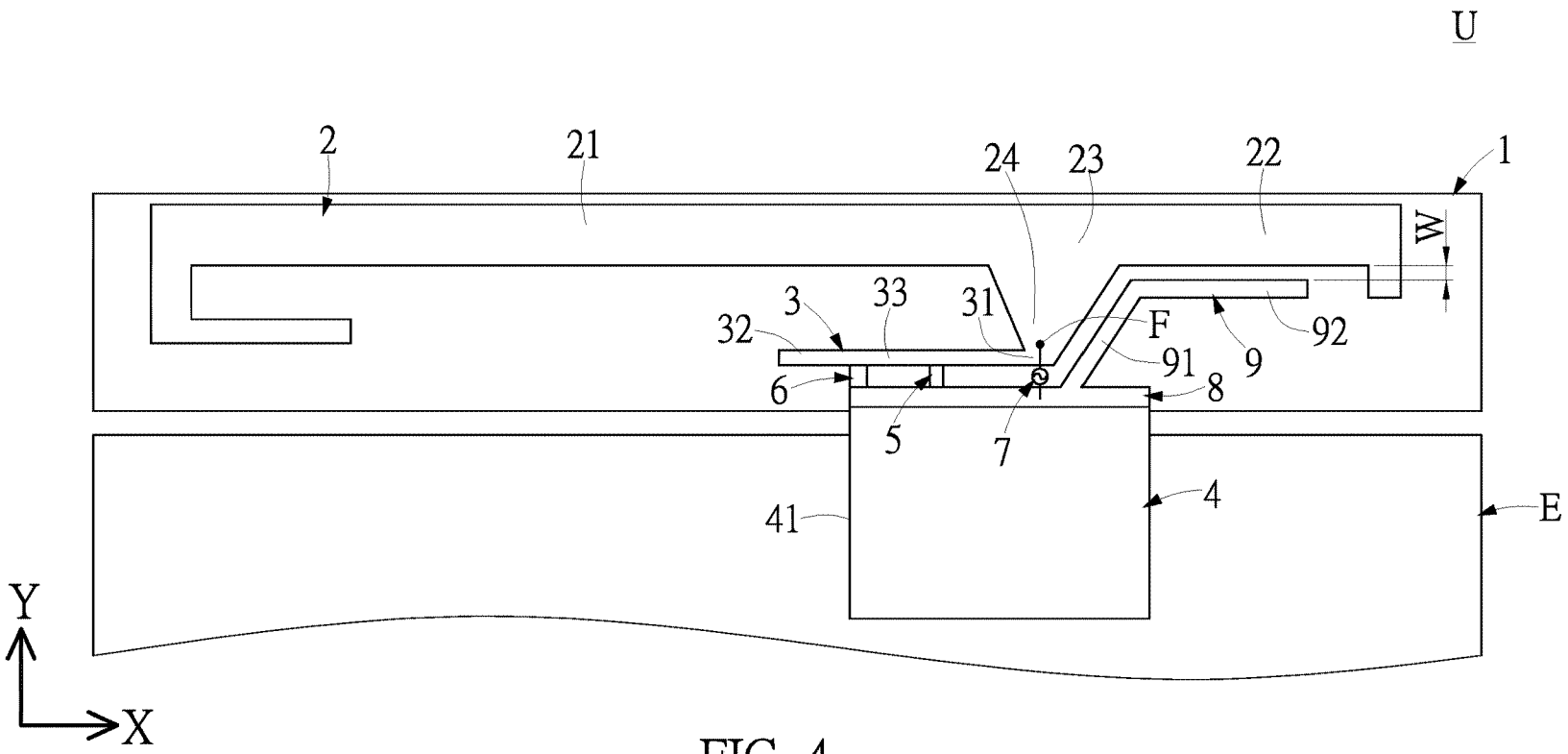
FIG. 4 shows yet another top view of the antenna structure according to the first embodiment of the present disclosure.

Next, please refer to FIG. 4, it can be known by comparing FIG. 4 and FIG. 2 that the main difference between FIG. 4 and FIG. 3 is that the antenna structure U shown in FIG. 4 further includes a parasitic element 9, the parasitic element 9 may be disposed on the substrate 1, and one end of the parasitic element 9 may be coupled to the grounding element 4. Further, the parasitic element 9 may has a first parasitic portion 91 coupled to the grounding element 4, and a second parasitic portion 92 bending from the first parasitic portion 91 and extending away from the feeding portion 24. It should be noted that, in other embodiments, the first parasitic portion 91 of the parasitic element 9 may be directly coupled to the grounding element 4. In addition, the second parasitic portion 92 of the parasitic element 9 and the second radiation portion 22 may have a predetermined slit W therebetween (W is a horizontal shift distance between the second parasitic portion 92 of the parasitic element 9 and the second radiation portion 22, i.e., the distance is between the second parasitic portion 92 of the parasitic element 9 and the second radiation portion 22).

Figure 5:
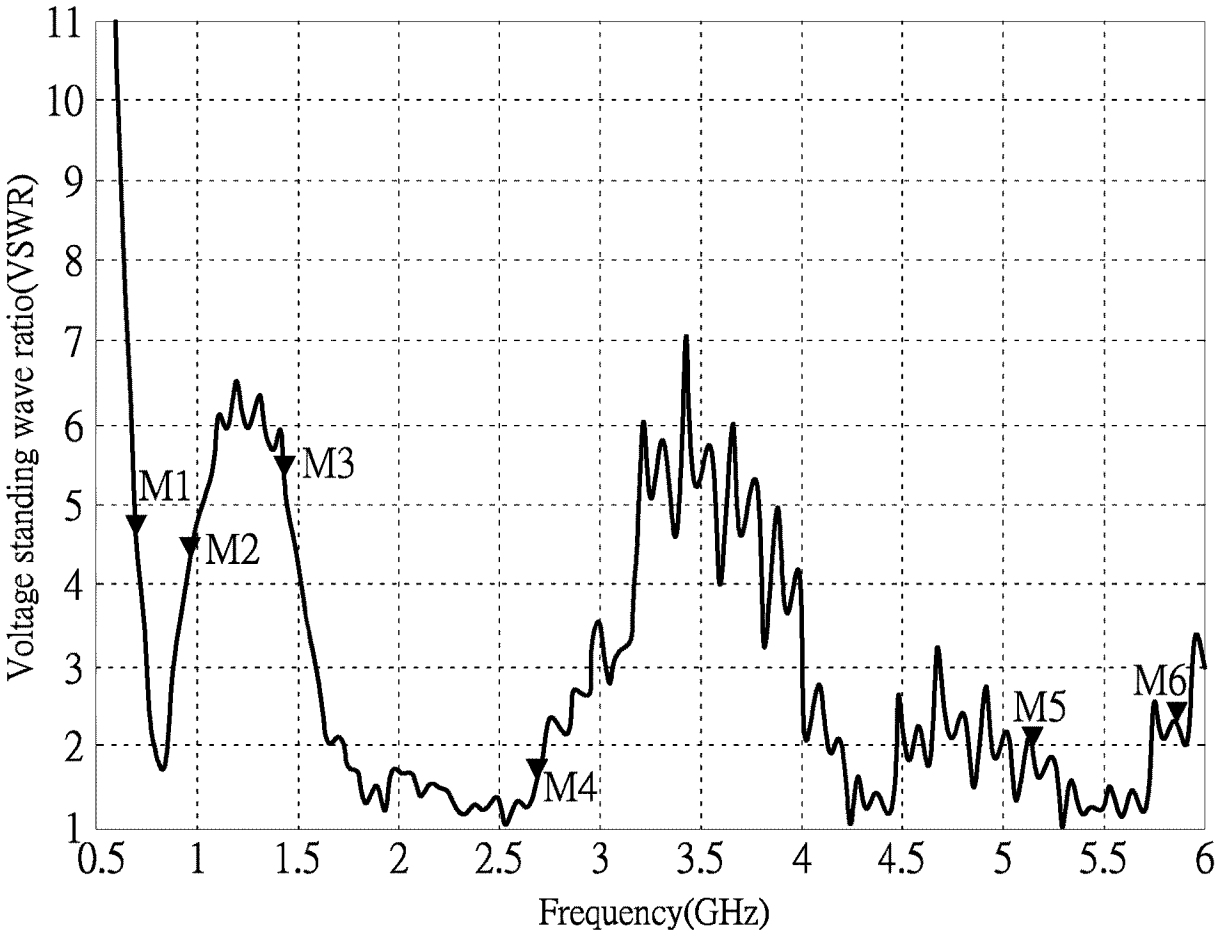
FIG. 5 is a diagram illustrating the curves of voltage standing wave ratios of the antenna under different frequencies according to the first embodiment of the present disclosure.

Next, please refer to FIG. 5 together with table a in the following, FIG. 5 shows a curve diagram of voltage standing wave ratios (VSWR) of the antenna under different frequencies according to the first embodiment of the present disclosure.

TABLE a

| Node | Frequency(MHz) | Voltage standing wave ratio |
|---|---|---|
| M1 | 698 | 4.60 |
| M2 | 960 | 4.34 |
| M3 | 1425 | 5.35 |
| M4 | 2690 | 1.61 |
| M5 | 5150 | 2.02 |
| M6 | 5850 | 2.28 |

Figure 6:
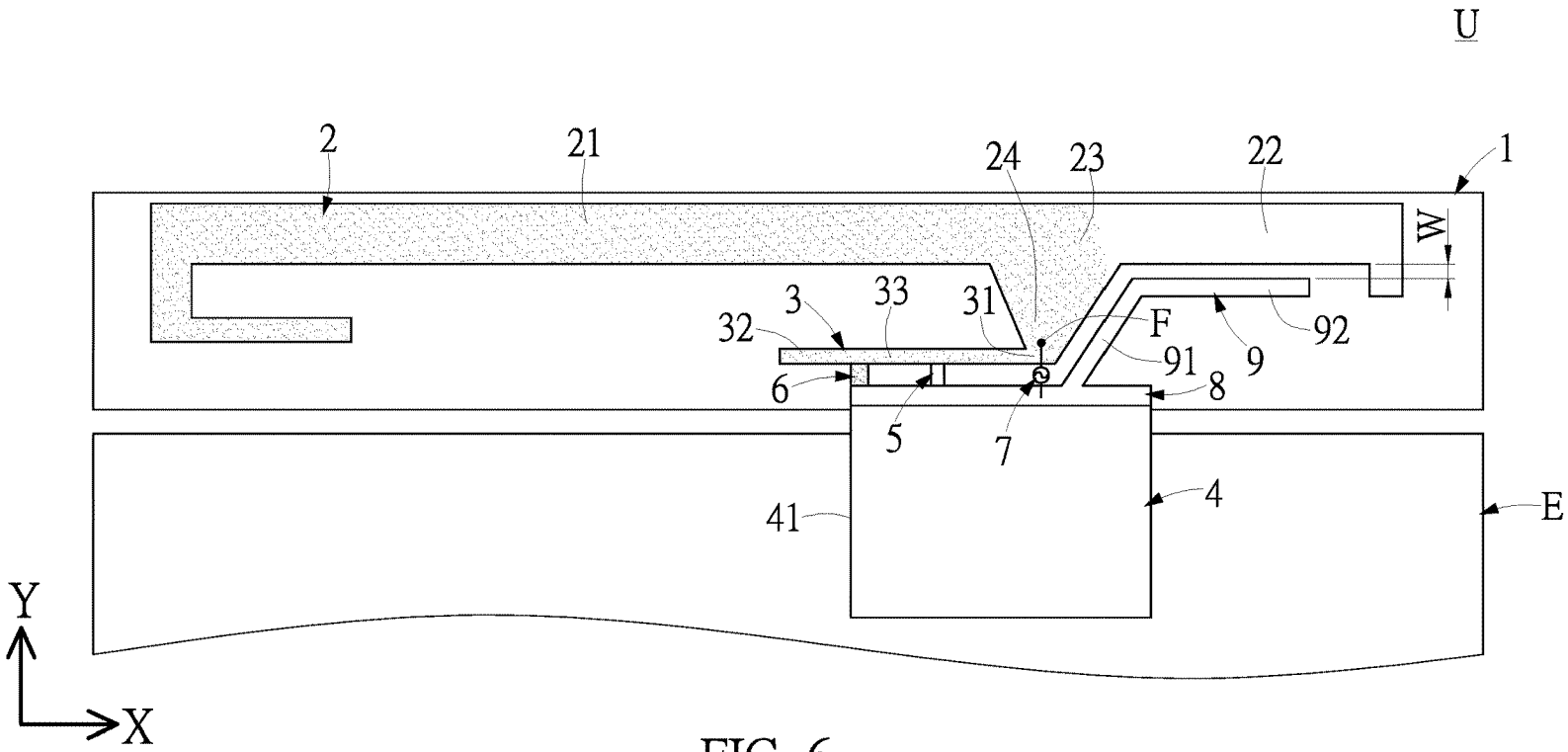
FIG. 6 shows a radiation diagram of a first radiation portion according to the first embodiment of the present disclosure.
Figure 7:
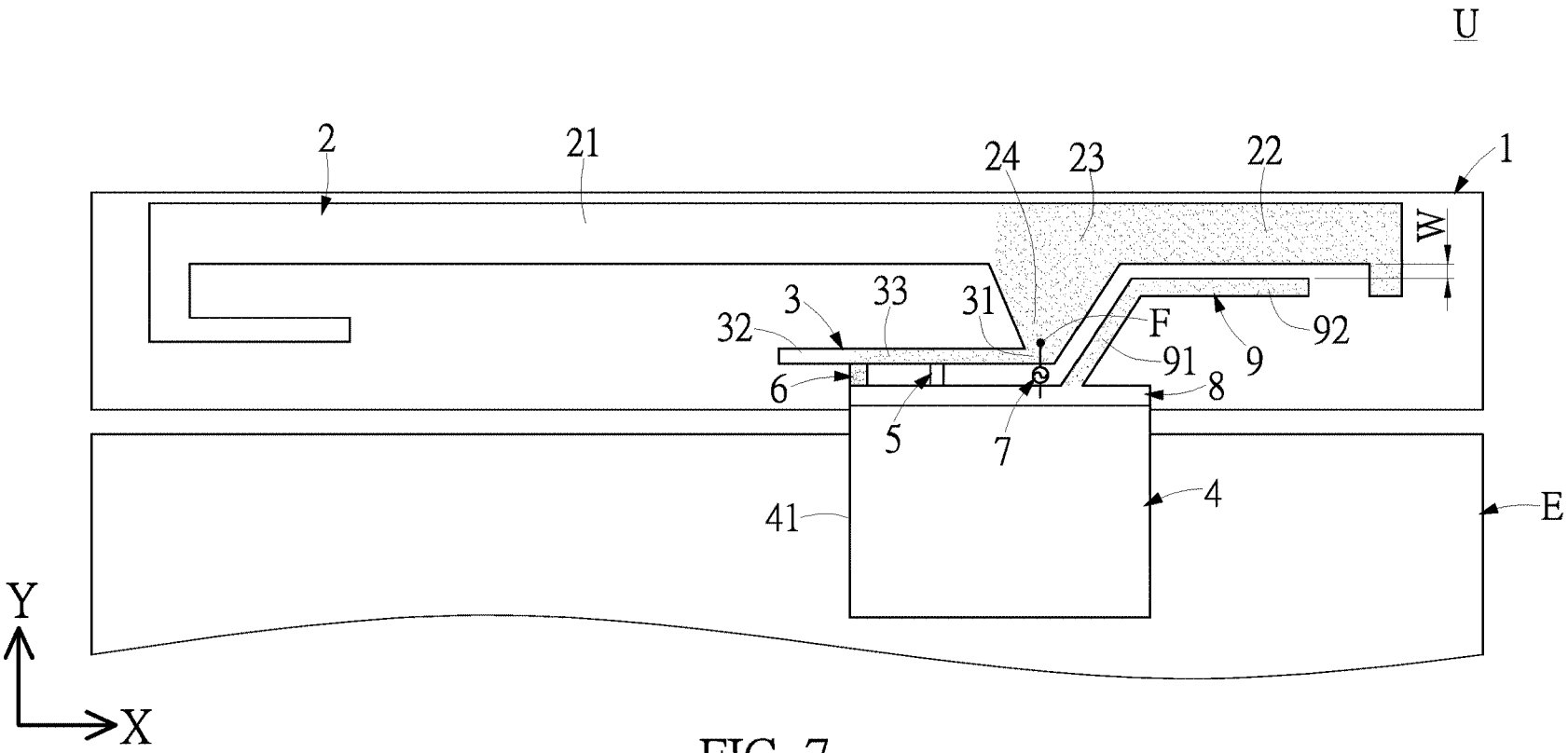
FIG. 7 shows a radiation diagram of a second radiation portion according to the first embodiment of the present disclosure.
Figure 8:
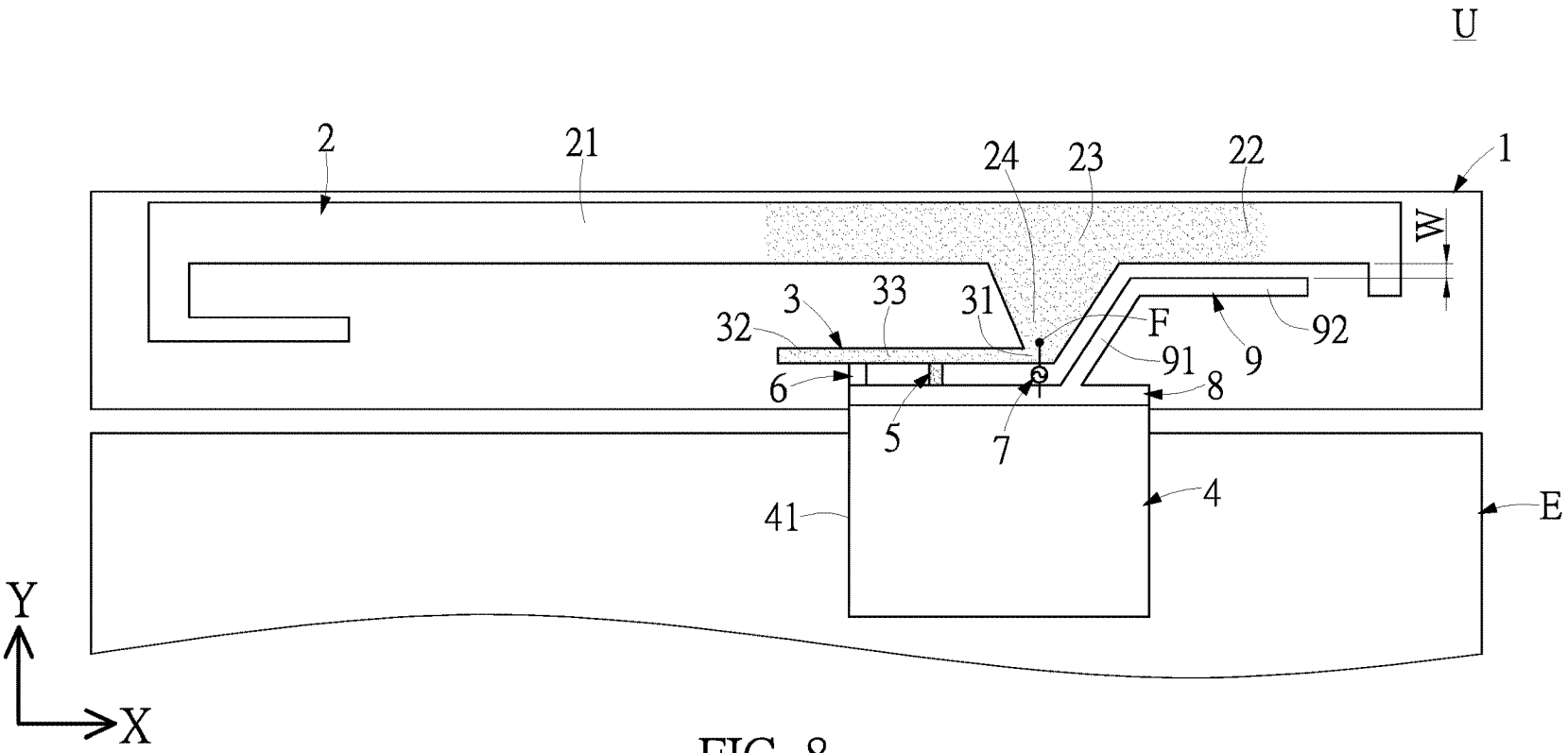
FIG. 8 shows a radiation diagram of a third radiation portion according to the first embodiment of the present disclosure.

Next, please refer to FIG. 4, and refer also to FIG. 6 to FIG. 8. In the embodiment of the present disclosure, a length of the first radiation portion 21 is greater than that of the second radiation portion 22. The first radiation portion 21 provides a first operation band of a frequency ranging between 698 MHz to 960 MHz (bandwidth), and the second radiation portion 22 provides a second operation band of a frequency ranging between 1425 MHz to 2690 MHz to be applied to the band of 4G long term evolution (LTE), but the present disclosure is not limited thereto. In addition, a third operation band may be generated from the third radiation portion 23, a part of the first radiation portion 21 and a part of the second radiation portion 22, and the third operation band has a frequency ranging between 5150 MHz to 5850 MHz to be applied to the band of 5G wireless LAN (WLAN), but the present disclosure is not limited. In addition, for the sake of brevity, the examples in the following embodiment will be the first operation band ranging between a frequency of 698 MHz to 960 MHz, the second operation band ranging between a frequency of 1425 MHz to 2690 MHz, and the third operation band ranging between a frequency of 5150 MHz to 5850 MHz.

Please refer to FIG. 4, FIG. 6 to FIG. 8, in which the radiation condition of the first radiation portion 21, the second radiation portion 22 and the third radiation portion 23 will be further described. The dot block in FIG. 6 to FIG. 8 provides the main radiation portion of the operation band. In detail, as shown in FIG. 6, a first operation band may mainly be generated from the feeding element 7, the first radiation portion 21, the third radiation portion 23, the conducting element 3, the second inductor 6 and the grounding element 4. In addition, as shown in FIG. 7, a second operation band may mainly be generated from the feeding element 7, the second radiation portion 22, the third radiation portion 23, the conducting element 3, the second inductor 6 and the grounding element 4. Furthermore, as shown in FIG. 8, a third operation band may mainly be generated from the feeding element 7, the conducting element 3, the third radiation portion 23, a part of the first radiation portion 21 (an overlapped part of the third radiation portion 23 and the first radiation portion 21), a part of the second radiation portion 22 (an overlapped part of the third radiation portion 23 and the second radiation portion 22), the first inductor 5 and the grounding element 4.

It should be noted that, through the parasitic element 9 disposed near the second radiation portion 22 of the antenna structure U, the characteristic of the operation band (second operation band) of the second radiation portion 22 may be enhanced, and preferably, the characteristic of the band between 2000 MHZ to 3000 MHZ may be enhanced. More preferably, the characteristic at the frequency of 2600 MHZ may be enhanced. That is, the disposed parasitic element 9 can enhance the frequency range (bandwidth) of the high frequency part of the operation band of the second radiation portion 22. Furthermore, the horizontal shift distance between the second parasitic portion 92 and the second radiation portion 22 may be adjusted to adjust an impedance corresponding to a center frequency of the operation band generated from the second radiation portion 22, and thus to adjust a voltage standing wave ratio corresponding to the center frequency of the operation band.

As mentioned above, in other words, the disclosure of the present disclosure may have two loops, one loop is through the first inductor 5, the other is through the second inductor 6, and the two loops may apply one radiation element 2 and one feeding element 7 to achieve multiple bands. In addition, it should be noted that, the impedance corresponding to the center frequency of the third operation band can be adjusted through adjusting the inductance of the first inductor 5. Meanwhile, the impedance corresponding to the center frequency of the first operation band can be adjusted through adjusting the inductance of the second inductor 6. Furthermore, please refer to FIG. 3, in which the first preset distance L1 is inversely proportional to the center frequency of the third operation band provided by the third radiation portion 23, a part of the first radiation portion 21 and a part of the second radiation portion 22. In other words, the length of the protruding part of the second end 32 opposite to the edge 41 of the grounding element 4 may be used to adjust the center frequency of the third operation. That is, when the distance between the second end 32 and the edge 41 of the grounding element 4 increases, the center frequency of the third operation band may decrease. Oppositely, when the distance between the second end 32 and the edge 41 of the grounding element 4 decreases, the center frequency of the third operation band may increase.

Figure 9:
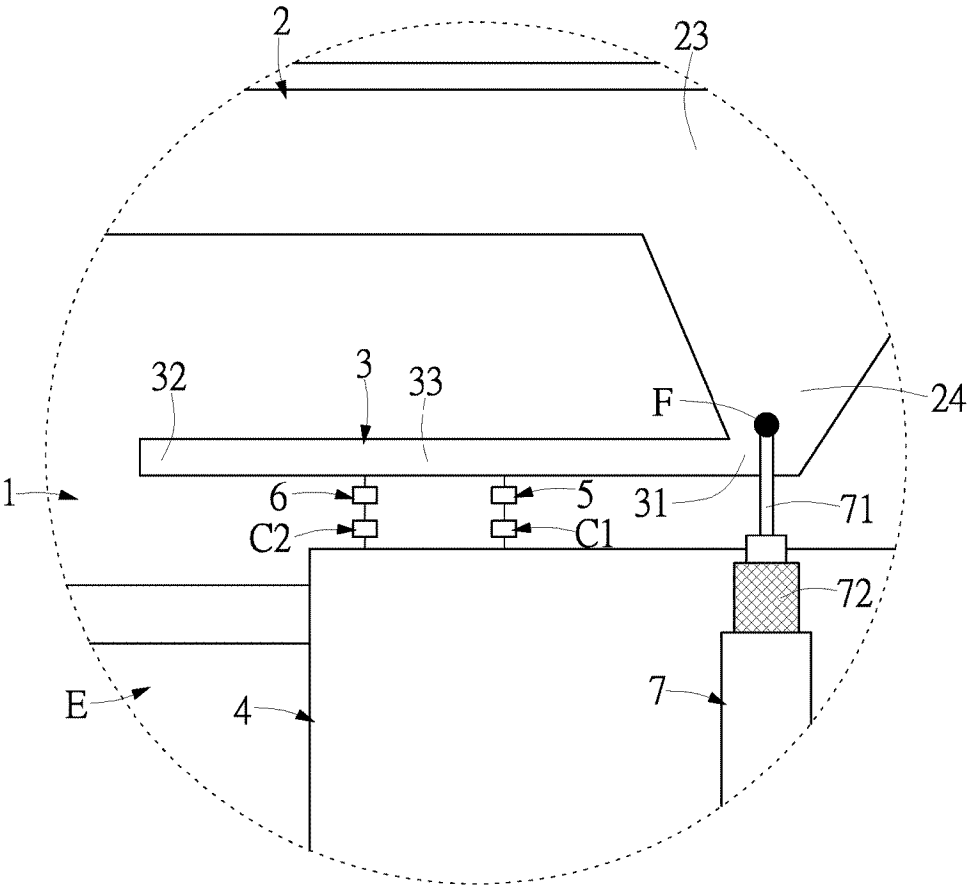
FIG. 9 shows a top view of an antenna structure according to a second embodiment of the present disclosure.

First, please refer to FIG. 9, FIG. 9 shows a top view of an antenna structure U according to a second embodiment of the present disclosure. It can be known by comparing FIG. 9 and FIG. 2 that the second embodiment mainly differs from the first embodiment in that: the antenna structure U in the second embodiment further includes a first capacitor C1 or a second capacitor C2. The first capacitor C1 may be disposed between the conducting element 3 and the grounding element 4, and the first capacitor C1 and the first inductor 5 are connected in series. In addition, the second capacitor C2 may be disposed between the conducting element 3 and the grounding element 4, and the second capacitor C2 and the second inductor 6 are connected in series. Furthermore, in other various embodiments, the first capacitor C1 or the second capacitor C2 may have one end connected to the conducting element 3 to be connected to the grounding element 4 respectively through the first inductor 5 and the second inductor 6.

Please refer to FIG. 9, it should be noted that, though the first capacitor C1 and the second capacitor C2 respectively are connected to the first inductor 5 and the second inductor 6 in series in FIG. 9, in other embodiments, only one of the first capacitor C1 or the second capacitor C2 may be disposed. Meanwhile, the impedance of the first operation band, the second operation band or/and the third operation band may be adjusted through the first capacitor C1 or/and the second capacitor C2 disposed. In addition, the frequency range of the first operation band, the second operation band or/and the third operation band may be adjusted. In addition, since other characteristics of the structures in the second embodiment are similar to that in the first embodiment, further description thereof is omitted herein.

Figure 10:
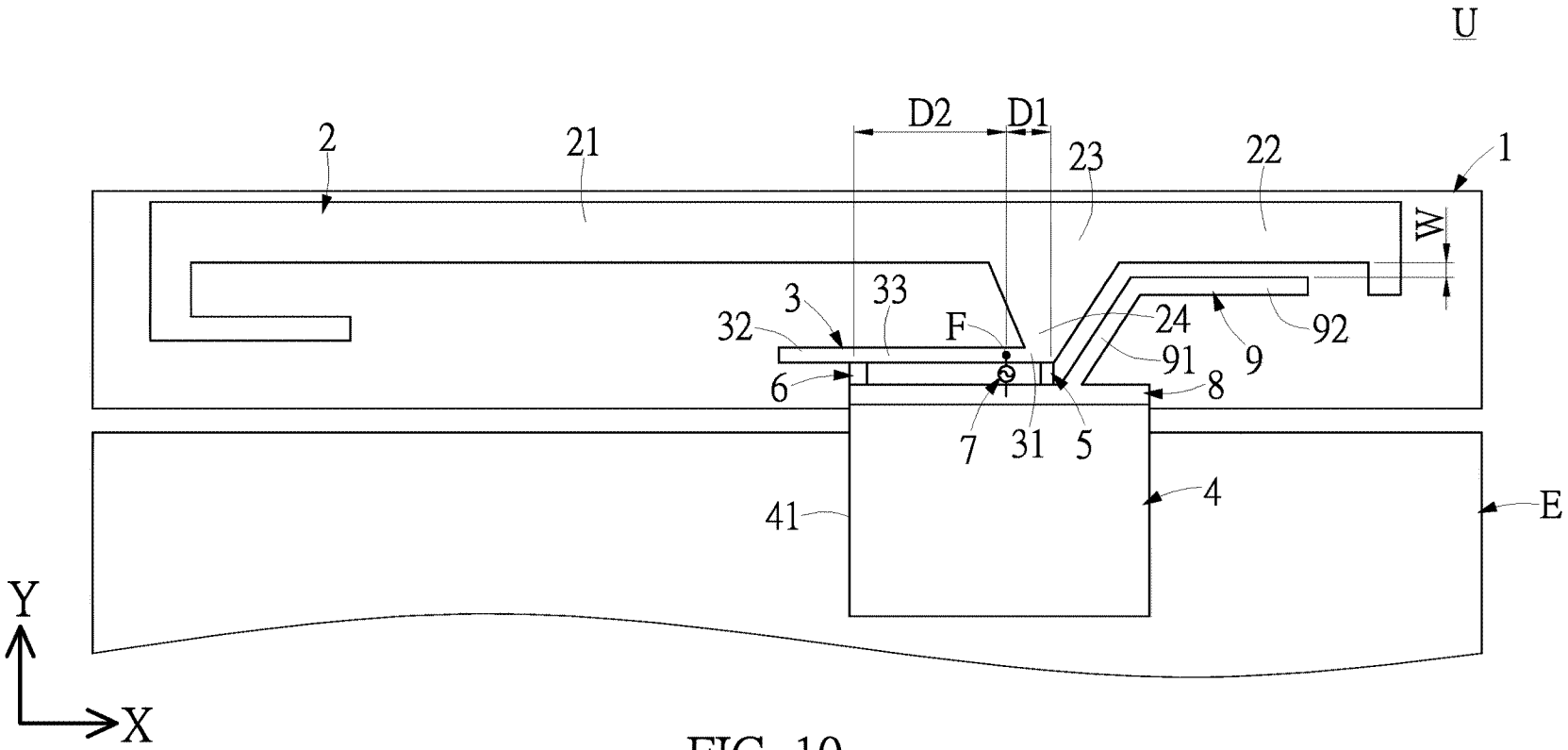
FIG. 10 shows a top view of an antenna structure according to a third embodiment of the present disclosure.

First, please refer to FIG. 10, FIG. 10 shows a top view of an antenna structure U according to a third embodiment of the present disclosure. It can be known by comparing FIG. 10 and FIG. 4 that the third embodiment mainly differs from the first embodiment in that: the first radiation portion 21 and the second inductor 6 are disposed on a first side of the feeding element 7, the second radiation portion 22 and the first inductor 5 are disposed on a second side of the feeding element 7. In other words, the first inductor 5 and the second inductor 6 are respectively disposed on two opposite sides of the feeding point F. That is, the first radiation portion 21 and the second inductor 6 may be disposed on left side of the feeding element 7, and the second radiation portion 22 and the first inductor 5 may be disposed on right side of the feeding element 7.

Please refer to FIG. 10, in detail, a feeding point F is disposed between the feeding element 7 and the conducting element 3, or between the feeding element 7 and the feeding portion 24, and in the third embodiment, the feeding end 71 of the feeding element 7 may be connected to the conducting element 3. In addition, a first predetermined distance D1 is between the first inductor 5 and the feeding point F, a second predetermined distance D2 is between the second inductor 6 and the feeding point F, and the first predetermined distance D1 is smaller than the second predetermined distance D2. In addition, the inductance of the first inductor 5 is smaller than that of the second inductor 6.

It should be noted that, in the third embodiment, though the first inductor 5 is disposed at a different position from that in the first embodiment, a first operation band ranging between 698 MHz to 960 MHz mainly may be generated from the feeding element 7, the first radiation portion 21, the third radiation portion 23, the conducting element 3, the second inductor 6 and the grounding element 4. In addition, a second operation band ranging between 1425 MHz to 2690 MHz mainly may be generated from the feeding element 7, the second radiation portion 22, the third radiation portion 23, the conducting element 3, the second inductor and the grounding element 4. Furthermore, a third operation band ranging between 5150 MHz to 5850 MHz mainly may be generated from the feeding element 7, the conducting element 3, the third radiation portion 23, a part of the first radiation portion 21 (an overlapped part of the third radiation portion 23 and the first radiation portion 21), a part of the second radiation portion 22 (an overlapped part of the third radiation portion 23 and the second radiation portion 22), the first inductor 5 and the grounding element 4. In addition, other characteristics of the structures in the third embodiment are similar to that in the first embodiment, and further description thereof is omitted herein.

The present disclosure is advantageous in that the antenna structure U provided by the embodiment of the present disclosure uses the features of "the first inductor 5 being coupled between the conducting element 3 and the grounding element 4", "the second inductor 6 being coupled between the conducting element 3 and the grounding element 4" and "the feeding element 7 being coupled between the feeding portion 24 and the grounding element 4 to be used to feed a signal" so as to make the antenna structure cover both the bands of 4G and 5G. In other words, the present disclosure may use a loop through the first inductor 5 and a loop through the second inductor 6, the radiation element 2, and the feeding element 7 together to achieve the multiple bands in a single antenna structure.

The aforementioned descriptions merely represent the preferred embodiments of the present disclosure, without any intention to limit the scope of the present disclosure which is fully described only within the following claims. Various equivalent changes, alterations or modifications based on the claims of the present disclosure are all, consequently, viewed as being embraced by the scope of the present disclosure.

What is claimed is:

1. An antenna structure comprising:

a substrate;

a radiation element disposed on the substrate, the radiation element including a first radiation portion, a second radiation portion, a third radiation portion and a feeding portion connected between the first radiation portion, the second radiation portion and the third radiation portion;

a conducting element disposed on the substrate and connected to the feeding portion;

a grounding element separated from the feeding portion;

a first inductor disposed on the substrate and coupled between the conducting element and the grounding element;

a second inductor disposed on the substrate and coupled between the conducting element and the grounding element; and a feeding element coupled between the feeding portion and the grounding element and used to feed a signal;

wherein a first operation band is mainly generated from the feeding element, the first radiation portion, the third radiation portion, the conducting element, the second inductor and the grounding element, a second operation band is mainly generated from the feeding element, the second radiation portion, the third radiation portion, the conducting element, the second inductor and the grounding element, and a third operation band is mainly generated from the feeding element, the conducting element, the third radiation portion, a part of the first radiation portion, a part of the second radiation portion, the first inductor and the grounding element.

2. The antenna structure of claim 1, wherein the first radiation portion and the conducting element extend along a first direction, the second radiation portion extends along a second direction, and the first direction is different from the second direction.

3. The antenna structure of claim 1, wherein the conducting element extends along a first direction, the conducting element has a first end, a second end being opposite to the first end and a body portion being connected between the first end and the second end, the first end being connected to the feeding portion, wherein a feeding point is disposed between the feeding element and the conducting element, or between the feeding element and the feeding portion, a first preset distance is between the feeding point and the second end, a second preset distance is between the feeding point and an edge of the grounding element, and the first preset distance is greater than the second preset distance.

4. The antenna structure of claim 3, wherein a length of the first preset distance is inversely proportional to a center frequency of a third operation band provided by the antenna structure.

5. The antenna structure of claim 1, wherein the first radiation portion and the second inductor are disposed on a first side of the feeding element, the second radiation portion and the first inductor are disposed on a second side of the feeding element.

6. The antenna structure of claim 1, wherein the first radiation portion is disposed on a first side of the feeding element, the second radiation portion is disposed on a second side of the feeding element, and the first inductor and the second inductor are disposed on the first side.

7. The antenna structure of claim 1, wherein the feeding element is coupled to the feeding portion through the conducting element, or the feeding element is directly connected to the feeding portion.

8. The antenna structure of claim 1, wherein a feeding point is disposed between the feeding element and the conducting element or disposed between the feeding element and the feeding portion, wherein a first predetermined distance is between the first inductor and the feeding point, a second predetermined distance is between the second inductor and the feeding point, and the first predetermined distance is smaller than the second predetermined distance.

9. The antenna structure of claim 8, wherein the inductance of the first inductor is smaller than an inductance of the second inductor.

10. The antenna structure of claim 1, further comprising:

a parasitic element disposed on the substrate and coupled to the grounding element;

wherein the parasitic element has a first parasitic portion coupled to the grounding element and a second parasitic portion bending from the first parasitic portion and extending away from the feeding portion.

11. The antenna structure of claim 1, further comprising:

a bridge element disposed on the substrate;

wherein the bridge element is coupled between the grounding element, the first inductor, the second inductor and the feeding element.

12. The antenna structure of claim 1, further comprising:

a first capacitor disposed between the conducting element and the grounding element, and the first capacitor and the first inductor are connected in series.

13. The antenna structure of claim 12, further comprising:

a second capacitor disposed between the conducting element and the grounding element, and the second capacitor and the second inductor are connected in series.

14. The antenna structure of claim 1, wherein the first operation band ranges between a frequency of 698 MHz to 960 MHz, the second operation band ranges between a frequency of 1425 MHz to 2690 MHz, the third operation band ranges between a frequency of 5150 MHz to 5850 MHz.

15. An antenna structure comprising:

a substrate;

a radiation element disposed on the substrate, the radiation element including a first radiation portion, a second radiation portion, a third radiation portion and a feeding portion connected between the first radiation portion, the second radiation portion and the third radiation portion;

a conducting element disposed on the substrate and connected to the feeding portion;

a grounding element separated from the feeding portion;

a first inductor disposed on the substrate and coupled between the conducting element and the grounding element;

a second inductor disposed on the substrate and coupled between the conducting element and the grounding element; and a feeding element coupled between the feeding portion and the grounding element and used to feed a signal;

wherein a feeding point is disposed between the feeding element and the conducting element or disposed between the feeding element and the feeding portion, wherein a first predetermined distance is between the first inductor and the feeding point, a second predetermined distance is between the second inductor and the feeding point, and the first predetermined distance is smaller than the second predetermined distance;

wherein the inductance of the first inductor is smaller than an inductance of the second inductor.

16. An antenna structure comprising:

a substrate;

a radiation element disposed on the substrate, the radiation element including a first radiation portion, a second radiation portion, a third radiation portion and a feeding portion connected between the first radiation portion, the second radiation portion and the third radiation portion;

a conducting element disposed on the substrate and connected to the feeding portion, the conducting element including a first end connected to the feeding portion, a second end being opposite to the first end and a body portion being connected between the first end and the second end;

a grounding element separated from the feeding portion;

a first inductor disposed on the substrate and coupled between the conducting element and the grounding element, the first inductor directly coupled to the grounding element;

a second inductor disposed on the substrate and coupled between the conducting element and the grounding element, the second inductor directly coupled to the grounding element; and a feeding element coupled between the feeding portion and the grounding element and used to feed a signal;

wherein a first preset distance is between the feeding point and the second end, a second preset distance is between the feeding point and a junction between the second inductor and the conducting element, and the first preset distance is greater than the second preset distance.

* * * * *